US006584965B1

(12) United States Patent
Ward

(10) Patent No.: US 6,584,965 B1
(45) Date of Patent: Jul. 1, 2003

(54) HIGH EFFICIENCY HIGH ENERGY FIRING RATE CD IGNITION

(76) Inventor: Michael A. V. Ward, c/o Combustion Electromagnetics, Inc. 32 Prentiss Rd., Arlington, MA (US) 02476

( * ) Notice: Subject to any disclaimer, the term of this patent is extended or adjusted under 35 U.S.C. 154(b) by 0 days.

(21) Appl. No.: 09/622,659

(22) PCT Filed: Feb. 20, 1999

(86) PCT No.: PCT/US99/03564

§ 371 (c)(1),
(2), (4) Date: Oct. 6, 2000

(87) PCT Pub. No.: WO99/42722

PCT Pub. Date: Aug. 26, 1999

(51) Int. Cl.[7] ..... F02P 3/08; F02P 15/08
(52) U.S. Cl. ..... 123/605; 123/620
(58) Field of Search ..... 123/596, 598, 123/604, 605, 609, 620; 315/209 CD; 361/256

(56) References Cited

U.S. PATENT DOCUMENTS 5,315,982 A * 5/1994 Ward et al. ..... 123/598
5,456,241 A * 10/1995 Ward ..... 123/169 EL
5,947,093 A * 9/1999 Ward ..... 123/169 EL

FOREIGN PATENT DOCUMENTS

WO WO 95/13470 * 5/1995

* cited by examiner

*Primary Examiner*—Henry C. Yuen
*Assistant Examiner*—Arnold Castro
(74) *Attorney, Agent, or Firm*—Jerry Cohen; Perkins, Smith & Cohen

(57) ABSTRACT

Capacitive discharge system for ignitors of internal combustion engines with one ignition coil (T) per ignitor with one or more capacitors (6) and shunt switch means (5) associated with each such coil, together forming a coil primary ignition circuit of Type II topology and resonance oscillation capability, each switch means being a series combination of shunt diode (D) means and switch (SD) across the coils primary winding, with a voltage drop element (Vdb) across switch SD, the system constructed to produce capacitive ignition initial spark discharge of duration less than a quarter period of the resonance oscillation of the primary ignition circuit followed by an essentially triangular distribution decaying spark discharge of longer duration than the initial discharge, with switch SD to be turned off near or after spark circuit zero to divert residual primary discharge circuit through the voltage drop element.

33 Claims, 4 Drawing Sheets

HIGH EFFICIENCY HIGH ENERGY FIRING RATE CD IGNITION

CROSS-REFERENCE TO RELATED PATENT APPLICATIONS

This application has 35 U.S.C. 119 and Paris Convention priority from my U.S. provisional patent application No. 60/075,627, filed Feb. 21, 1998.

FIELD OF THE INVENTION

This invention relates to capacitive discharge (CD) ignition systems for internal combustion (IC) engines, and more particularly to improved CD ignitions with much higher efficiencies and much higher spark firing rates than achievable before for a given level and type of delivered spark energy. The invention is especially useful for the very efficient and rapid delivery of high energy spark discharges of the flow-resistant type which are preferred in advanced high efficiency IC engines with high in-cylinder airflows. The invention applies to both single coil distributor type ignition systems as well as to more modern one-coil-per-plug distributorless type ignition. In the case of the distributor version, the high efficiency and high spark firing rate make the system especially useful in high speed eight cylinder (V-8) engines operating at speeds up to and above 9,000 RPM and providing the more useful flow resistant, single polarity, triangular, arc discharge mode type spark with minimum heat dissipation. In the case of one-coil-per-plug ignition, the high efficiency of the system allows for delivery of more of the limited available energy associated with smaller ignition coils and/or lower electrical energy generating systems, as in a flying magnet system found in small engine applications. The invention relies, in part, on the use of ignition coils with improved side-by-side windings and with improved silicon-iron laminated cores for achieving the higher efficiencies, and in part on the use of IGBT and FET switches and high efficiency diodes for controlling and shaping the discharge of the energy storage capacitors (also referred to hereinafter as "discharge capacitors") as well as the primary and secondary winding currents to insure good operation throughout a wide range of speeds, from cranking to very high speeds or high firing rates.

BACKGROUND OF THE INVENTION AND PRIOR ART

Current capacitive discharge (CD) ignition systems are very inefficient, with typically 15% to 25% efficiency, and deliver typically only 20 to 30 millijoules (mJ) of spark energy per single spark pulse (into an industry standard 800 volt Zener load). On the other hand, evidence points to a requirement of over 100 mJ of spark energy for best engine performance of a standard automobile engine. In addition, CD ignition coils are typically wound with concentric primary and secondary windings to give relatively low leakage inductance for a given number of primary wire turns, which contributes to the low efficiency of the ignition system, versus the three times and higher efficiency of 60% to 70% achieved in the present invention.

Current CD systems also typically use silicon control rectifiers (SCRs) which discharge all the capacitively stored energy upon ignition firing. This results in slower recharging of the discharge capacitors to a potentially lower energy and peak voltage, as well as poorer use of the power source. This can be a particular problem when lower energy is available for delivery to the capacitor, as in the case of engines running at very high speeds (less charging time) or flying magnet systems under engine cranking conditions. On the other hand, the present system uses switches that can be turned off, preferably insulated gate bipolar transistors (IGBTs), and a discharge circuit design and control which allows for the capacitor charging during ignition spark firing.

Modern ignition coils use laminations which are butt-welded and have mounting holes punched in the laminations. Such designs reduce the coil discharge efficiency and increase coil heat dissipation. Moreover, they use relatively thick laminations, i.e. 14 mil (thousands of an inch) or thicker, which results in lower coil efficiency when applied to the present, more optimal, preferred side-by-side winding coil topology which is more sensitive to certain aspects of lamination design, as was discovered, requiring alternative designs for the laminations, geometry, and mounting.

In the present application, segmented secondary coil windings are provided to limit coil output capacitance Cs (to help insure voltage doubling), as well as inductive suppressor wire to reduce electromagnetic interference (EMI), where applicable. However, to improve the spark's ignitability, capacitive spark plug boots, or improved spark plugs with built-in capacitance, are preferred for the present application.

In the case of high speed engines with single coil distributor ignitions, high circuit efficiency along with use of the preferred triangular, versus sinusoidal, primary and secondary winding spark current distribution leads to problems at high engine speeds when a coil may be fired well above 200 Hertz (Hz). This problem occurs because of the imperfect coupling between the primary and secondary windings ($k<1$), resulting in a residual primary current after the secondary current has dropped to zero. The residual primary current then decays at a much lower rate dictated by the ignition coil primary circuit losses alone so that at high coil firing rates there may be a non-zero primary current when the ignition refires, reducing the secondary spark current at high speeds. While this problem may be largely off-set by designing the discharge circuit for the sinusoidal current distribution, this has several drawbacks, including and not limited to not allowing charging of the discharge capacitor during spark firing. In the present invention is disclosed improved and optimized methods of handling this problem.

In the automotive case where battery power is used (12, 24, or future 42 volt), the power converters which are used to step-up the voltage to the typical 200 to 600 volts are generally inefficient and electrically noisy, with efficiencies between 35% and 70%, and up to 85% in practice in my U.S. Pat. No. 5,558,071. In the present application is disclosed improvements to increase power converter efficiency to between 90% and 94%, important in minimizing heat dissipation in the high temperature engine environment, especially where small, lightweight packaging of the parts is preferred.

By careful and innovative design of the entire system, from the power stage, to the discharge circuit, to the ignition coil, to the spark plug wires and spark plug itself, one can achieve a very high efficiency and a high spark discharge energy. In the case of a single coil distributor ignition system one can have a more optimized system for very high speeds with much higher energy density (spark energy per unit weight) with minimum heat dissipation, and in the case of one-coil-per-plug ignition systems one can have very small, low cost parts, producing high spark energy very efficiently.

SUMMARY OF THE INVENTION

The system of the present invention is applicable to single coil distributor and one-coil-per-plug distributorless CD ignition systems. The system uses controllable coil primary winding circuit main switch means Si (S for distributor systems) which can be turned-off prior to the discharge of the energy storage capacitor, and diode means Di (D for distributor systems) shunting the coil primary winding of high efficiency coils with side-by-side windings producing an essentially triangular distribution of primary current Ip and secondary current Is. The system is designed to provide the highest efficiency as a complete system as well as in terms of individual parts and sub-systems. It delivers maximum spark energy for a given stored energy, produces low component and system heat dissipation, and provides the most rapid and efficient recharging of the discharge capacitors, especially at very high switching speeds as occurs in single coil distributor ignition systems found in high speed multi-cylinder engines.

In a preferred embodiment, the discharge capacitor is not fully discharged by the main discharge switch S or Si, which is preferably an IGBT, which operates to leave a significant voltage on the capacitor, e.g. 20% to 40% of the initial voltage, or approximately 130 volts for the high firing rate distributor ignition case of preferred capacitor voltage Vc of 360 volts, which allows for quicker restart of the power converter and more rapid recharge of the capacitor, especially at high engine speeds in a V-8 engine where there is not much time for charging.

In another preferred embodiment, especially useful for single coil distributor ignition systems operating with a preferred high efficiency flyback power converter, use is made of an additional second switch SD in the discharge circuit in series with the shunt diode D, which is closed during most of the spark firing and then modulated 180° out-of-phase with the power converter switch SPC after the spark current Is has neared zero current or after it has reached zero current. In doing this: 1) the residual primary current is diverted and diminished rapidly instead of building up in the coil primary winding to lead to core saturation; 2) the residual primary current Ip is diverted back to the battery for best efficiency; and 3) the diversion of the residual primary winding energy occurs in a way that presents a low voltage drop during the charging stage of the discharge capacitor by the power converter, i.e. when the power converter switch SPC is turned off, maximizing power converter efficiency and output power with coil primary residual energy diversion. In this way, the ignition coil may be fired at a very high rate with the highest possible efficiency, even with the preferred triangular current distribution. Timing for turning off switch SD and beginning its out-of-phase modulation is obtained preferably by monitoring the spark current Is with a sense resistor and transistor, such that when the current Is is small, say 1/10th its peak, switch SD may be turned off and modulated. However, other means of turning off switch SD may be used, especially if the spark firing duration is known at high speeds.

The ability to provide very rapid firing of an ignition coil without limiting the coil energy or depending on coil resistance to damp the residual primary current, allows for the design of very high energy coils with the highest efficiency ever attained. Such designs are achieved with coils with side-by-side windings. They are further improved by allocating greater winding length, i.e. approximately 1/3 the total winding length to the primary winding, and using Litz wire when several layers of heavy gauge wire are required to minimize coil AC resistance. The coil efficiency is further increased by another factor relating to the recognition of the non-symmetrical nature of the magnetic flux in the magnetic core and the resulting magnetic leakage flux that cuts across the winding window on the primary winding side of the core, requiring thin, preferably 6 mil laminations, or other low loss magnetic core material such as powder iron, in the half of the core associated with the primary winding. Use of high leakage inductance Lpe of the coil, typically in the 200 to 500 microhenry (uH) range, resulting in lower frequency operation, and the use of the preferred triangular current distribution with large direct current (DC) component, also increase coil efficiency by minimizing the high frequency loss effect of the leakage flux for a given thickness of lamination in the primary winding half of the core.

Typically used heat sink material, such as aluminum extrusions surrounding the coil, absorb significant coil energy in the present side-by-side winding case through eddy currents produced by the leakage magnetic field. In the present system, heat sinks are designed to minimize eddy current losses by confining them to the coil end sections, or by using non-electrical but high thermally conductive, cast, aluminum powder based heat sink material and coil mounting parts. The coil and housing structure is made to provide good heat transfer from the windings and central coil regions to the outside of the coil. For preferred laminated silicon-iron cores, preferably square (or rectangular) winding bobbins are used with square center hole and winding with minimum wall thickness without electrical breakdown, especially on the primary winding side. If round bobbins are used, laminations with several center leg widths are used to minimize the paths between the outside surface of the center leg sections and inside of the windings and to maximize magnetic core area. Also, hybrid cores can be used with powder iron in the primary winding section of the coil and laminations in the other half.

For the coil parameters, approximately 50 turns of primary winding Np are preferred, i.e. 40 to 60 turns, and a turns ratio N of approximately 65 is used for 400 volt rating discharge capacitors. This gives a leakage inductance Lpe in the range of 200 to 500 uH, depending on the specific coil design for the preferred side-by-side winding. Peak spark current Is is typically in the range of 200 to 800 milliamps (ma), depending on application, and preferably in the 400 to 600 ma range for good spark flow-resistance with acceptable spark plug erosion. For the single, large coil, distributor application, preferably 13 to 15 equivalent AWG (American Wire Gauge) Litz wire is used in a four to eight layer primary winding, preferably six layer, to provide a good fill of the primary winding section or bay, with 30 to 33 AWG magnet wire for the secondary winding. For the smaller, one-coil-per-plug application, preferably 15 to 18 AWG magnet wire is used (preferably in six layers) and selected to give primary winding AC resistance close to the DC resistance, and preferably 33 to 36 AWG magnet wire is used for the secondary winding. In both cases, preferably the winding ends are on the same side of the coil with the high voltage tower on one end and the primary wire winding ends and secondary start lead on the other end, for ease of manufacture and use. The larger, distributor ignition, single coil is preferably cast in a mold with the outside surfaces of the laminations exposed to the air for best cooling. The distributorless ignition coils may be cast similarly, or in a housing, as they require much less cooling. As used herein, the term "approximately" means within ±20% of the term it qualifies. When there is no qualification on the value of a parameter, it shall be taken to mean the value ±10%.

In the single coil distributor designs shown, the discharge topology preferred is Type II, in which the discharge capacitor is in series with the coil primary, one end of which is grounded. The shunt diode placed across the primary winding is the path through which the capacitor is charged. In this topology, the initial negative voltage on the primary winding side of the capacitor can be used as a signal to control turn-off of the main discharge switch S/Si for partial discharge of the capacitor. Type I topology, used in the one-coil-per-plug distributorless application, can be used in the distributor multi-cylinder version, where the capacitor is across the power converter output, and the main switch is in series with the primary winding to ground.

In the case where high spark current is desired, e.g. one amp peak spark current for drag racing, a coil design using concentric windings but open end E-lamination may be used to provide the required low leakage inductance Lpe of approximately 80 uH, primary inductance Lp about ten times greater than Lpe, achieved with approximately 60 turns of primary winding. The core open end allows for easier and cheaper assembly of the coil, disclosed in my patent application PCT/US96/19898 on inductive ignition. Such designs will not be discussed in this application which emphasizes high efficiency achieved with the use of coils with side-by-side windings and by other means.

For automotive applications, to maximize circuit efficiency and minimize heat dissipation, the flyback converter disclosed in the cited patent and patent application is improved by lowering its frequency of operation to about 20 kHz, i.e. 12 to 28 kHz, where the term "about" means within ±40% of the term it qualifies, to minimize switching losses of the power switch PCS, core and ultra-fast output diode. The power converter transformer Tr is designed with two or three layers of secondary winding (with low AC losses at the operating frequency) for lower transformer losses and higher secondary winding capacitance. Single layer primary winding is used with Litz wire. For a two layer secondary, the primary may be located between the layers to minimize leakage, known to those versed in the art. The power converter snubber is designed such that after power converter switch PCS opening, the snubber capacitor voltage decays to a voltage equal to the secondary voltage transformed to the primary side, and not to zero. In addition, a small high voltage capacitor may be placed on the output of the converter transformer Tr to reduce the ultra-fast output diode switching losses.

In this application preferably capacitive boots for the spark plugs or capacitive spark plugs are used, with inductive, low resistance wire under 20 ohms/foot if practical to reduce EMI without spark energy loss and without eliminating the capacitive or breakdown spark. High capacitance of the spark plug, e.g. 30 to 60 picofarads (pF), may be achieved by using high dielectric constant insulator material, e.g. an aluminum zirconia mix, with metallic coating on the insulator in the capacitance region.

It is a principal object of the present invention to provide CD ignition systems of both the distributor and distributorless type that have the highest possible efficiency, 60% to 70% battery-to-spark efficiency (using an industry standard 800 volt Zener as the spark-gap load), and to accomplish this by the choice of components and by the design of new components, sub-systems, and the complete system as a whole made up of power converter, discharge circuit, ignition coil, spark plug wire, and spark plugs.

It is another object of the present invention to use the high efficiency design of the present invention to provide a high energy spark of the triangular distribution type operating in the low arc discharge mode of 200 ma to 800 ma to provide the most effective ignition of an air-fuel mixture over the entire range of engine speeds and loads and engine types, all of which are accomplished by the present invention. This includes using the flow resistant features of the spark to advantage and including a high capacitance or breakdown spark with minimum EMI achieved by using capacitive spark plugs or boots in conjunction with the present system, to give the most effective ignition under all possible conditions.

Other features and objects of the invention will be apparent from the following detailed description of preferred embodiments taken in conjunction with the accompanying drawings.

DESCRIPTION OF PREFERRED EMBODIMENTS

Figure 1:
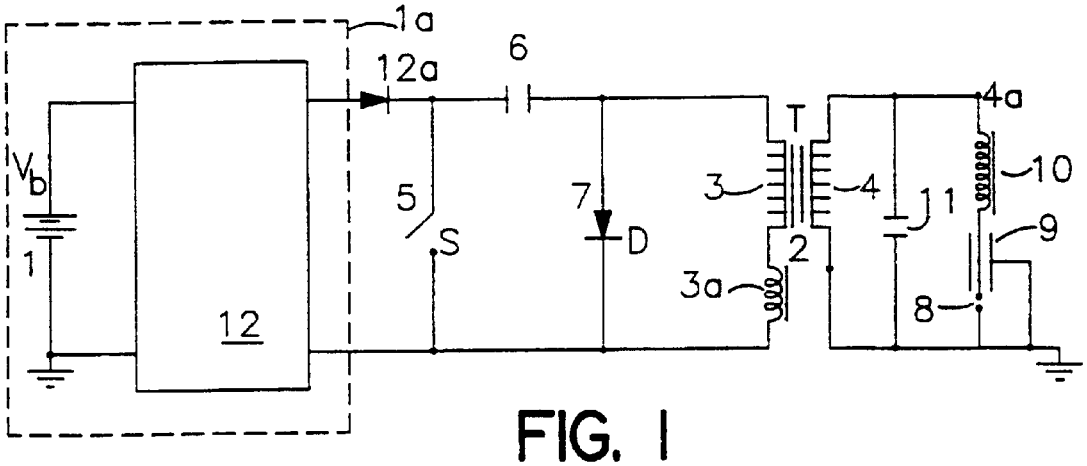
FIG. 1 is a partial block, partial circuit diagram of an improved topology II, CD, single coil distributor type ignition circuit powered by a car battery.

FIG. 1 is a partial block, partial circuit diagram of a topology II, CD, single coil distributor type ignition circuit, powered by a car battery 1 (voltage Vb) with ignition coil 2

(T) with primary winding 3 of turns Np and inductance Lp and coil primary leakage inductance Lpe (shown as an external inductor 3*a* in this figure), and secondary winding 4 of inductance Ls, with the windings 3 and 4 wound on a magnetic core. The ignition discharge circuit is fired by means of main switch 5 (S) to partially discharge capacitor 6 of capacitance Cp through current flow Ip through switch S and through the coil 2 primary winding 3, with current Ip flowing through the shunt diode D (7) upon switch S opening to produce a triangular spark current in spark gap 8 of a spark plug 9 with capacitance Cp1 either built into the spark plug or contained in a capacitive spark plug boot. Preferably, low resistance inductive spark plug wire 10 is used to suppress the capacitive spark associated with the secondary winding 4 coil output capacitance 11 of capacitance Cs, which is minimized by segmenting the coil secondary winding as is known to those versed in the art. The useful breakdown spark is obtained from the discharge of the high voltage energy stored in the spark plug, or spark plug boot capacitance Cp1. Typically, the coil secondary high voltage terminal 4*a* is connected to a distributor (not shown), which has a number of spark plug leads and plugs. Only one spark plug lead 10 is shown herein for simplicity, shown directly connected to the high voltage coil terminal 4*a*.

In this preferred topology II circuit, main switch 5 is across the output of a power converter 12 with output diode 12*a*, which charges up discharge capacitor 6 to a voltage Vc, typically between 200 and 600 volts, through the shunt diode 7 (D) shunting the primary winding of the coil. Main switch 5 is preferably an insulated gate bipolar transistor, IGBT. In this configuration, only the first quarter sine wave current can flow through the switch 5, with the main, longer duration, decaying primary current flowing through the shunt diode 7, which is preferably a high efficiency heat-sunk diode. Following turn-on of main discharge switch S, switch S is turned off at a voltage Vci (before capacitor 6 is fully discharged) to allow for rapid recharging of capacitor 6, which can begin immediately following turn-off of switch S.

In this topology II circuit, the discharge capacitor 6 is in series with the high side of the power supply and returned to ground (low side of the power supply) through the shunt diode 7 shunting the coil primary winding. This results in the wires to the coil being at ground potential even when capacitor 8 is charged, versus in the topology I case of FIG. 2 where they are at a voltage Vc.

In FIG. 1 the power supply shown is assumed to be that of an automobile. In the more generic form it is shown as a box 1*a* with dashed lines, which can be any of a variety of energy sources 1*a* or electrical generators, including and not limited to the flying magnet type found in small engines, the power mains of a house (used in igniter system for a burner), an alternator, and others. However, in their application to the current CD ignition they share an output diode 12*a* through which they charge energy storage and discharge capacitor 6 to a given voltage Vc (which includes the value of Vc taking on a range of voltages from some minimum to some maximum).

Figure 2:
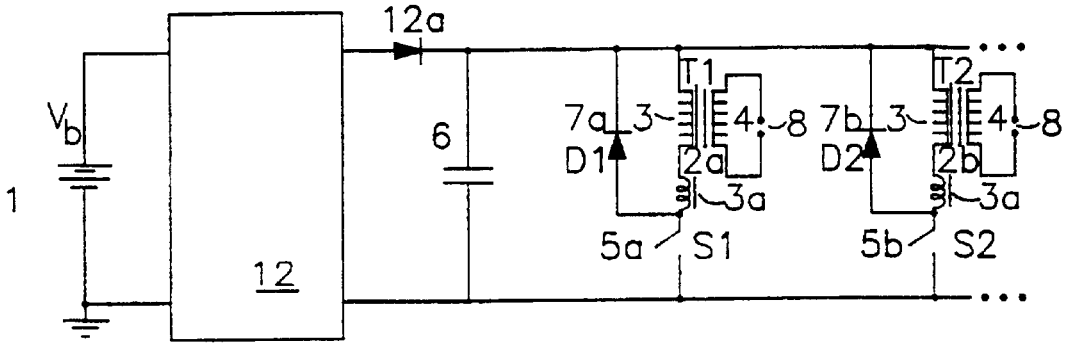
FIG. 2 is a circuit diagram, partially block diagram and partially detailed circuitry, of an embodiment of a distributorless version of the CD ignition system depicting two of "n" number of parallel cascaded ignition coils T1, T2, . . . Tn, featuring certain improvements in design and operation.

FIG. 2 is a circuit diagram, partially block diagram and partially detailed circuitry, of an embodiment of a distributorless version of the CD ignition system depicting two of "n" number of parallel cascaded ignition coils T1, T2, . . . Tn, each comprised of a primary winding 3 and secondary winding 4 wound on a magnetic core. Like numerals represent like parts with respect to FIG. 1. The symbol Ti will be used to designate an arbitrary coil, i.e. the "ith" coil, of an arbitrary number of "n" coils. The coils T1, T2, . . . Tn, are part of the spark discharge circuit including the energy storage and discharge capacitor 6, main discharge switches S1 (5*a*), S2 (5*b*), . . . Sn, for the coils T1, T2, . . . Tn, which,with coil primary windings 3 comprise a primary discharge circuit.

The primary discharge circuit includes the shunt diodes D1, D2, . . . Dn, which have their anodes connected to the anodes of switches S1, S2, . . . Sn, and have their cathodes connected to the high sides of the coils T1, T2, . . . Tn. As in the circuit of FIG. 1, the initial primary discharge current Ip will flow through switches Si and the later, and major part, of the current through shunt diodes Di, with preferably capacitor 6 not fully discharged. Preferably shunt diodes Di are located at their corresponding coils Ti to minimize the number of wires and gauge of the wiring between the box containing the power converter and discharge circuit components and the coils.

The basic spark firing operation of the circuits of FIGS. 1 and 2 involves the turning on of switches S/Si which results in the charging of the output capacitance connected to the coil secondary winding (Cs and Cp1) to a high voltage Vs (of typically 20 to 40 kilovolts, kV, maximum, depending on application), which breaks down the spark gap 8 to deliver the spark energy in a triangular distribution spark current Is. The spark current is preferably in the low arc discharge mode of 200 to 800 ma, typically with a peak amplitude of approximately 500 ma, obtained from a preferred coil leakage inductance Lpe of 200 to 600 microHenries (uH), preferably approximately 300 uH for a capacitor voltage approximately 360 volts with capacitance Cp of 2 to 6 microFarads (uF), preferably approximately 4 uF, sufficient to insure voltage doubling for a given total secondary output capacitance, as disclosed in my U.S. Pat. No. 4,677,960.

Preferably, switch S/Si is opened when voltage Vci remains on the capacitor equal to 20% to 40% of the initial capacitor voltage Vc, e.g., when the voltage Vc has dropped to approximately 120 volts for Vc equal to approximately 360 volts. For Vci equal to 30% of Vc, only approximately 10% of the capacitor energy is not delivered, yet the power converter charging time is reduced by over three times of the 10%, i.e. by over 30% of the time required to charge a fully discharged capacitor because the power output increases with the level of the output voltage.

Figure 3A:
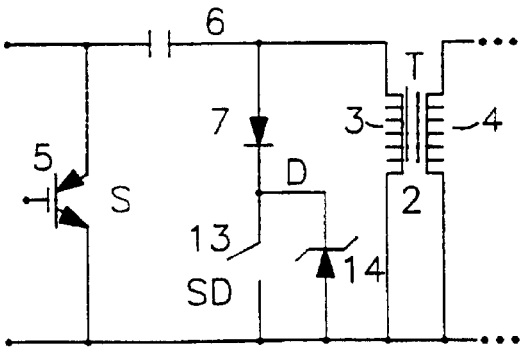
FIGS. 3*a* and 3*b* depict partial circuit drawings of FIG. 1 including a second switch means SD in series to ground with the main discharge diode D for improving the high firing rate operation of the ignition with a DC spark component.
Figure 3B:
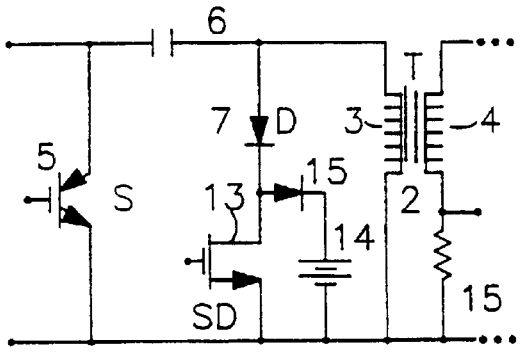

FIGS. 3*a* and 3*b* depict partial circuit drawings of variants of the FIG. 1 circuit including a second switch means 13 (SD) in series to ground with discharge diode D. For simplicity, the leakage inductance of the coil has not been shown as a separate inductor 3*a* in this case. Like numerals represent like parts with respect to FIG. 1. Switch SD is preferably high efficiency switch, such as a low voltage (e.g. 30 volt) field-effect transistor, FET, shown in FIG. 3*b*. By turning off switch SD close to, or after, the end of the spark discharge, any residual primary current is diverted, in the case of FIG. 3*a*, to the Zener diode 14 of preferably low Zener voltage of 3 volts to 6.2 volts, to allow for more rapid decay of the remaining primary current that exists after the spark current has dropped to zero. However, the preferred geometry for diversion of the residual primary current is that of FIG. 3*b*, where the residual current is diverted through diode 15 to the power source or supply, e.g. the battery of an automobile.

The embodiment of FIG. 3*b* can be viewed as a best efficiency regenerative system in that the residual energy is not wasted but recovered and stored in the battery (or input filter capacitors). Once switch SD (13) is turned-off to perform its current diverting role (spark current Is near or at zero), then by modulating switch SD 180° out-of-phase with power converter switch PCS (see FIG. 4), then when current is flowing to charge capacitor 6 (during switch PCS opening), switch 13 is closed to minimize the capacitor 6 charging voltage drop, and opened when PCS is closed (no capacitor 6 charging current) to perform its current diverting function and maximize efficiency.

Figure 4:
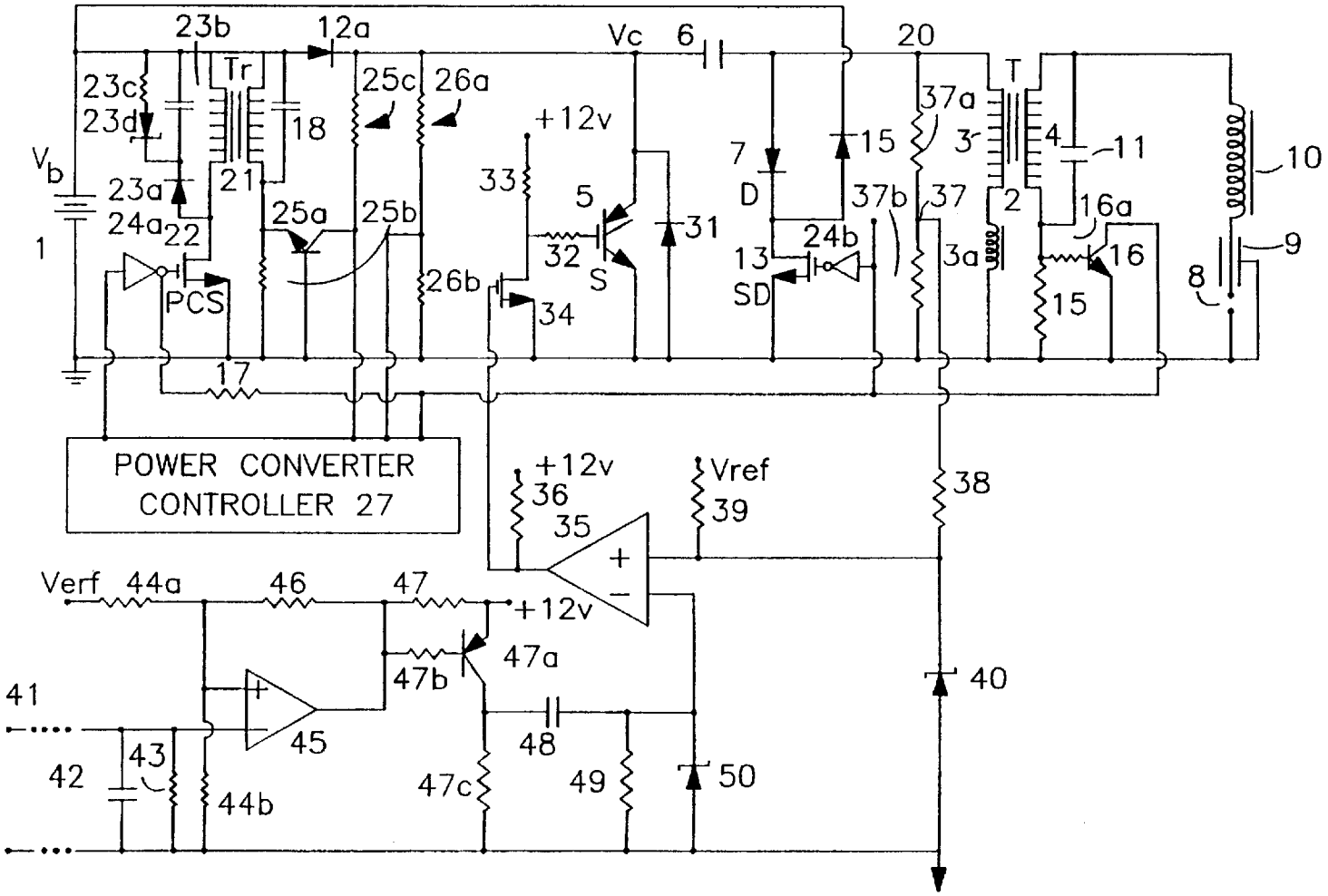
FIG. 4 is a more detailed, largely circuit drawing of a preferred embodiment of the topology II distributor CD ignition of FIG. 1, depicting details of a preferred and improved power converter, improved discharge circuit which uses an IGBT as the main switch S, and the improved primary current diverting circuit of FIG. 3*b*, among other features and improvements.

FIG. 4 is a more detailed, largely circuit drawing of a preferred embodiment of the topology II distributor CD ignition of FIG. 1, depicting details of a preferred and improved power convener 12, an improved discharge circuit which uses an IGBT as the main switch S (5) (which can be turned off before capacitor 6 is fully discharged to speed up its recharging), and the improved primary current diverting circuit of FIG. 3*b*, among other features and improvements. IGBT turn-off is controlled by a new form of control circuit based on sensing the negative voltage of the voltage discharge waveform. Like numerals represent like parts with respect to FIGS. 1 to 3*b*.

For the DC-DC converter 12 is shown a flyback converter of the type disclosed in U.S. Pat. No. 5,558,071 comprised of low leakage transformer 21, N-type FET switch 22 (50 to 75 volt rating), snubber circuit made up of diode 23*a*, capacitor 23*b*, resistor 23*c*, and zener diode 23*d* to limit the discharge of the snubber capacitor to a voltage equal to the output voltage Vc transformed to the input side, i.e. Vc divided by the transformer Tr (21) secondary to primary turns ratio Ntr, where Ntr is preferably between 14 and 20 for the case of a 12 volt battery 1 and output voltage Vc of approximately 360 volts (and modified accordingly for different voltages Vb and Vc). Required input filter capacitors are not shown. The power FET switch 22 (PCS) is preferably driven by a high current, high speed dual inverting FET driver 24*a* whose other half 24*b* drives switch SD (13), typically including not shown external FET gate resistors. The power converter current sense means is comprised of an NPN sense transistor 25*a*, sense resistor 25*b*, and off-time timing resistor 25*c*. Output voltage regulation uses resistors 26*a* and 26*b*. Remaining components making up the driver of FET 22 and converter controller are shown as block 27.

The discharge circuit comprises IGBT 5 with protection diode 31 across it. The drive circuit for the IGBT comprises gate resistor 32 connected to a supply voltage (12 volts regulated voltage shown) through a pull-up resistor 33. To the gate resistor 32 is connected IGBT control switch 34 which normally keeps the IGBT gate low (IGBT off). Control switch 34 is N-type FET with drain connected to the gate resistor 32 and source to ground and its gate connected to the output of a comparator 35 with pull-up resistor 136 to a supply voltage (12 volts shown). The comparator output is normally high, keeping control switch 34 turned-on and switch S off (gate of IGBT 5 pulled to ground). Normally, inverting input of comparator 35 is low (no trigger signal) and its non-inverting input is high.

Turn-on of IGBT 5 is achieved by a trigger signal raising comparator 35 inverting input above a threshold voltage Vth. Turn-off uses a voltage sensing circuit instead of current sensing because when approaching the turn-off voltage of say 0.2·Vc to 0.4·Vc, the primary current through transistor switch S is close to its maximum sine wave value which is slowly varying with time, versus the voltage at node 20 (normally low side of discharge capacitor 6) which changes rapidly as it approaches zero volts (and the peak of the primary current is approached). Therefore, voltage instead of the normal current sensing is used.

The sense circuit is comprised of a voltage divider made up of resistors 37*a* and 37*b* connected between node 20 and ground (of common values, for example, 47K and 2.2K respectively). To the intersection of the divider (node 37) is connected resistor 38, connected in turn to the non-inverting input of control comparator 35, to which is also connected resistor 39 taken to a reference voltage Vref, e.g. 5 volts, and a Schottky diode 40 taken to ground (anode to ground). The effect of this circuit is to apply a threshold voltage Vth to the non-inverting input at all times except during ignition firing (Vth somewhat less than Vref). Upon ignition firing, node point 20 (voltage Vnode) goes negative to voltage approximately −Vc and decays as a cosine with quarter period Tc equal to $1/2 \cdot \pi \cdot \sqrt{[Lpe \cdot Cp]}$, typically 30 to 60 usecs. At the non-inverting input of comparator 35, designated as the sense node of voltage Vsense, the two voltages Vref and Vnode are summed, weighted by the resistors of the sense circuit, to produce the voltage Vsense. Voltage Vsense is prevented from going more negative than two tenths of a volt by Schottky diode 40. Upon ignition triggering, voltage Vsense drops from Vth to ground, remains at ground for most of the quarter period Tc, then rises towards Vth while the trigger voltage Vtr decays to equal Vsense to correspond to the desired voltage Vci remaining on the discharge capacitor. When Vsense equals Vtr, the output of the comparator flips and returns to the high condition, turning on control switch 34 and turning off IGBT 5. The primary current through the IGBT switch diverts to shunt diode 7 as a triangular distribution current with corresponding secondary spark current.

For the trigger circuit any of a number are feasible. In this drawing is shown an input trigger node 41 to which are connected input components suitable for a variety of input triggers (to the left of the ellipses). In turn, the various input components are connected to a trigger conditioner comprised of a noise filter capacitor 42 with shunt resistor 43 connected between the inverting input of a comparator 45 and ground, and a hysteresis resistor 46 connected across the comparator. The comparator 45 non-inverting input is held at some reference voltage $V'_{ref}$ by means of resistor divider 44*a* and 44*b* taken to the reference voltage Vref. Output of comparator 45 is tied through a resistor 47 (value R47) to a reference voltage greater than Vref, 12 volts shown, and also to the base of a PNP transistor 47*a* through a base resistor 47*b*. The emitter of transistor 47*a* is taken to the 12 volts and its collector is taken to ground through resistor 47*c*. When transistor switch 47*a* is turned on, a timing signal Vtr is produced at the inverting input of comparator 35 by a differentiating trigger capacitor 48 (value C48) connected to the collector of switch 47*a* and terminated with a resistor 49 (value R49) to ground. Across the resistor 49 is a Schottky diode 50. Normally the collector of switch 47*a* is low with trigger capacitor 48 discharged. When a trigger is received, inverting input of the control comparator 35 goes high to Vtr and then decays as capacitor 48 is charged with a time constant equal to R49·C48, which typically will range between 10 and 20 microseconds depending on the discharge circuit quarter wave rise period Tc, the reference voltage Vref, and Vc divided down by divider 37*a*/37*b*.

The circuit for handling the residual primary current at the end of the spark firing comprises several components including sense resistor 15 of typical value about 10 ohms, placed between the low side of the secondary coil winding 4 and ground. To sense resistor 15 is connected the base of an NPN transistor 16 with emitter to ground and base resistor 16*a*. Its collector is taken to the input of inverting driver 24*b* which controls FET switch 13. In operation, when the ignition coil T is fired and the spark current is high (above 60 ma for a 10 ohm resistor 15), switch 16 is on, pulling driver 24*b* input low which turns on switch 13 to provide a low voltage drop of a fraction of a volt to ground for the primary current Ip flowing through discharge diode 7, as well as for the charging current Ich from the power converter. When the secondary current drops so that voltage at sense resistor 15 is below the base-emitter voltage of transistor switch 16, its collector goes open. After that, the output of power converter inverting FET driver 24*a*, which is also connected to the input of driver 24*b* through isolation resistor 17, modulates switch SD (13), i.e. turns it off and on, 180° out of phase with switch PCS (22) to provide a low voltage drop when charging current Ich flows through diode 7. When switch PCS (22) is on, switch SD (13) is off, diverting residual primary current through diode 15 to the battery 1 for maximum operating efficiency.

For the power converter transformer 21, preferably two to three layer magnet wire is used for the secondary winding, typically 26 to 30 AWG depending of the bobbin winding length and operating frequency, and one layer of Litz wire for the primary winding of eight to twelve turns for the present application of 12 volts battery input and 360 volts output (Vc). The transformer Tr magnetic core is preferably ferrite gapped core. Preferred converter operating frequency is about 20 kHz (12 to 28 kHz) with a non-zero DC current component approximately half the peak, e.g. 10 amps DC and 10 amps AC for 20 amps peak, with, for example, a switch on-time approximately 35 usecs and off-time approximately 15 usecs when output voltage Vc is approximately 360 volts, resulting in a period of approximately 50 usecs (20 kHz frequency). Output capacitor 18 of about 1 nanofarad is preferably included to reduce the switching losses of the preferred ultra-fast output diode 12*a*.

For spark plug wire 10 low resistance, i.e. 20 ohms/foot or less resistance, high inductance spark plug wire is preferred, e.g. with well over 200 uH inductance to reduce the peak break-down current from the coil secondary output capacitor 11 without limiting the overall spark energy. Spark plug capacitance of about 50 pF is preferred as will be discussed with reference to FIG. 8.

Figure 5:
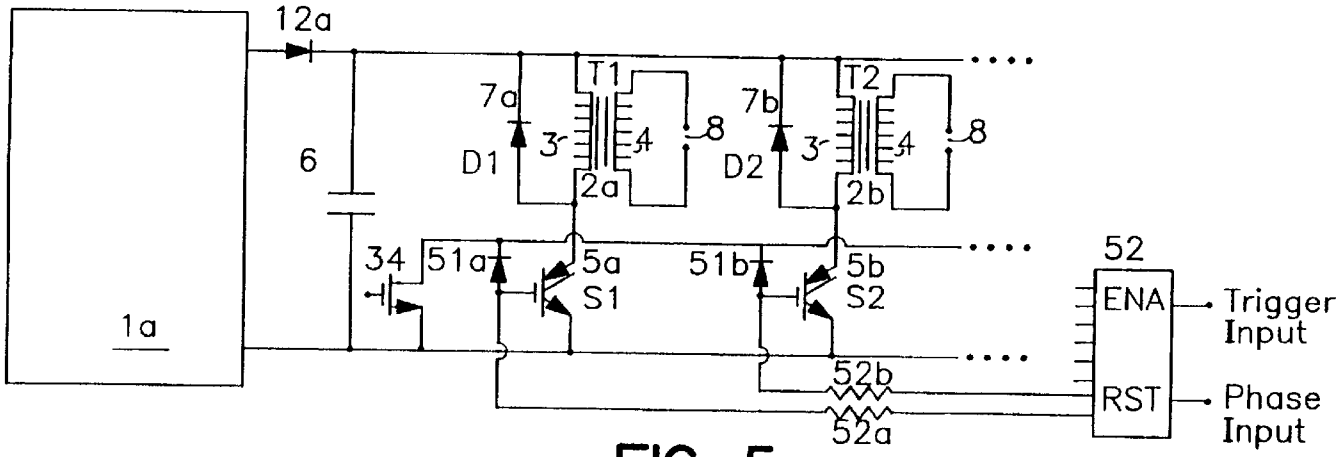
FIG. 5 is a partial block diagram partial circuit diagram of a preferred embodiment of a distributorless CD ignition of type I topology of FIG. 2, showing two of several possible coils with IGBT switches as the main switch elements and with shunt diodes across the primary windings of the coils.

FIG. 5 is a partial block diagram and partial circuit diagram of a preferred embodiment of a distributorless CD ignition of type I topology of FIG. 2, showing two of several possible coils using IGBTs 5*a*, 5*b*, . . . , as the main switch elements with shunt diodes 7*a*, 7*b*, . . . , across the primary windings of the coils 2*a*, 2*b*, . . . . Like numerals represent like parts with respect to FIGS. 1 to 4.

Turn-on and turn-off of the IGBT switches 5*a* and 5*b* use the same circuit of a control comparator 35 of FIG. 4 (not shown) and control switch 34 (N-type FET shown) except that isolation diodes 51*a*, 51*b*, . . . , are required for connecting the gates of the IGBT switches 5*a*, 5*b*, . . . , respectively to the drain of control FET switch 34. In addition, octal counter 52 is shown for energizing each IGBT switch in turn through resistors 52*a*, 52*b*, . . . . The enable (ENA) input of the octal counter accepts a trigger input, such as derived from the output of control comparator 35 with any of a number of input conditioning circuits appropriate for this topology (one of which has been disclosed by me elsewhere). The enable input is used for sequencing the counter with each trigger input. A phase input trigger (not shown) is used for resetting the counter, as is known to those versed in the art.

In this application, power converter 1*a* (generic type assumed) is kept on during ignition firing following switches Si turn-off. Shunt diodes D1, D2, . . . , are preferably high efficiency diodes which can be each located at its corresponding coil for lowest cost and best efficiency. The IGBT switches are preferably 400 to 600 volt switches that can provide the high peak currents of 30 to 50 amps with low collector to emitter drop (Vce). As in the case of FIGS. 1 and 4, switches Si are turned-off with a charge remaining on capacitor 6 (at a voltage Vci typically 20% to 40% of Vc) for rapid and efficient charging of the capacitor 6 and minimum power converter 1*a* requirements. Other switches than IGBTs may be used although they are the preferred for the present application where switch turn-off is required (versus SCRs which cannot be turned off).

To complement the high efficiency power converter and discharge circuits improved ignition coils are disclosed with side-by-side windings. As a complete system they allow for the maximum system efficiency which results in maximum energy being delivered to the spark with minimum heat dissipation of parts.

Figure 6B:
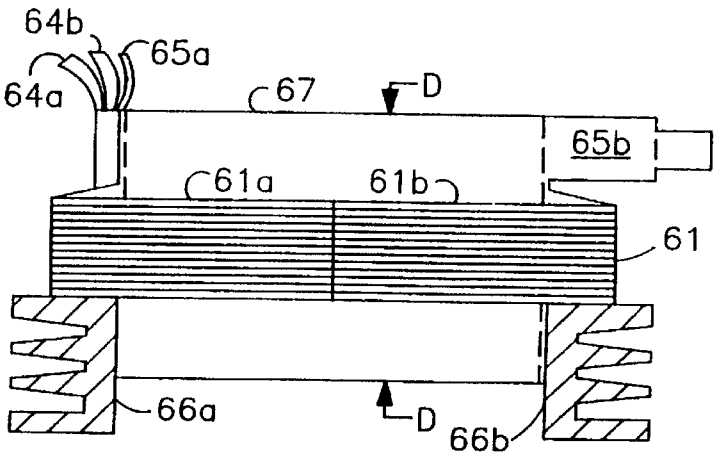
FIG. 6*b* is an approximately to-scale side view of the complete encapsulated coil of FIG. 6*a* with the wire ends located on the same side of the coil but at the two ends and combination heat sink/mounts at the two coil ends.
Figure 6A:
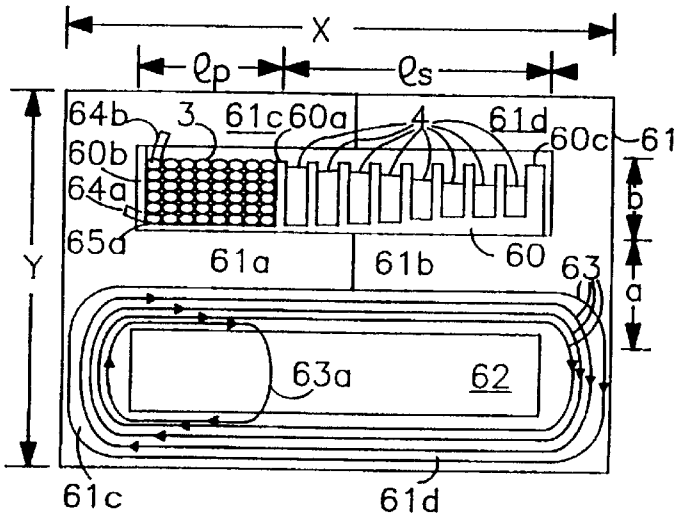
FIG. 6*a* is an approximately to-scale drawing of a top view of a preferred design of a high efficiency coil with side-by-side windings for the present application of a single coil distributor ignition of FIG. 1, featuring several improvements.

FIG. 6*a* is a preferred design of a side-by-side winding coil for the present application of a single coil distributor ignition (FIG. 1) which has primary winding 3 preferably of Litz wire of equivalent 13 to 15 AWG and of approximately 48 turns Np (for the preferred assumed 400 volt application), secondary winding 4 of preferably 30 to 33 AWG magnet wire, a bobbin 60 with radial flanges, and magnetic laminated core 61. The figure depicts a top view of the coil looking down on the lamination flats 61. One half of the view shows the winding construction and the bobbin 60 (understanding the other half of the winding window 62 has the same construction by definition), showing 48 turns Np of primary wire (6 layers of 8 turns per layer) and eight bays of secondary winding (which can be within a wide range dictated by the output voltage of the coil and by other requirements known to those versed in the art). The secondary windings 4 are indicated by shading and are of decreasing number of turns-per-bay as they progress from bay to bay starting from the primary winding end 3, to provide larger and larger inner and outer margins to accommodate the increasing voltages. The other half of the core shows the magnetic flux lines 63 through the core and air gap through the winding window.

FIG. 6*b* shows a side view of the complete encapsulated coil with the primary wire ends 64*a*, 64*b*, secondary start lead 65*a*, and the high voltage tower 65*b* all located on the same side of the coil but at the two ends, as shown, for easy encapsulation in a mold which is open at the winding wire ends. FIGS. 6*a* and 6*b* are approximately to-scale for a stored energy of about 200 mJ or greater.

Principal features of this design are the side-by-side windings with the primary winding 3, length "lp", and secondary segmented winding 4, winding window length "ls", wound on a bobbin 60, where length lp is approximately equal to one half of the winding length ls, and the preferred total length lp+ls is approximately equal to 2½ inches (6¼ cms) in this design. An equation describing approximately the leakage inductance of this type of winding structure is given by:

$$Lpe=(a/b+1)\cdot lw'\cdot(Np/10)^2 \text{ uH}$$

$$lw'=lp+ls+3\cdot dps \text{ cms}$$

where "a" is the core center leg width for a square core (or average side dimension of a rectangular core), "b" is the available winding height, "dps" is the sideways separation between the primary and secondary windings. For a round core, "a" is replaced by π/4 times the diameter of the core. For a preferred design of the coil the separation dps between windings (flange 60*a*) is made as thin as practical, about equal to the thickness of the flanges separating the secondary winding segments or bays, which makes lw' essentially equal to the length lw of the entire window, the additional factor 2·dps made up by the thickness of the end flanges 60*b* and 60*c*.

For the performance distributor ignition application preferred stored energy Ep is approximately 200 mJ. For an operating voltage Vc of approximately 360 volts (400+ voltage capacitor 6), approximately 3.5 uF capacitance is preferred with preferably leakage inductance Lpe of approximately 250 uH.

Typical dimensions for a 200+ mJ distributor ignition coil based on using two E-laminations of the ⅝ LW (Thomas & Skinner) type for the core or a core with similar dimensions, are "a" equal to ⅝" (1.6 cms), "b" equal to 0.4" (1 cm), winding window length lw equal to 2.6" (6.6 cms), primary turns Np equal to 48, and turns ratio N of secondary winding turns Ns to primary turns Np (Ns/Np) equal to 65 for 400 volt rating capacitors, where "equal to" in this context as already mentioned means ±10% of the quantity it references. Overall coil dimensions are length X equal to 3.5" (9 cms) and width Y equal to 2⅝" (7 cms) with preferably square magnetic core and bobbin. If a round bobbin is used, then preferably laminations with two, or three, or more center leg widths are used. Preferred diameter D of encapsulant of the coil is 1.8" (4.5 cms) to cover the winding window. The peak magnetic flux in this case is approximately one half of saturation which helps keep the core losses down given that the coil is required to be driven hard by being fired at a rate as high as 400 to 600 Hz when operating a V-8 engine from 6000 to 9000 RPM. The width of the lamination flats at the ends along the Y dimension is preferably more than the usual half of the center leg width, especially on the primary winding core half (as indicated also in FIG. 7*a*).

It has been discovered that since the magnetic field (flux) lines 63 cross the winding window gap (flux line 63*a*) at the primary winding lamination half 61*a* at the flange 60*a* section where the two windings abut, that it is advantageous to make this lamination half (of the two E-lamination halves) of more expensive, low loss magnetic material, such as 6 mil silicon-iron lamination, the other half being of thicker, cheaper material, e.g. 7 to 14 mil. This provides lowest loss (best efficiency) and best economy. Operation is improved by using the preferred largely DC versus AC current distribution, i.e. the preferred triangular current distribution with low frequency AC component obtained from high leakage inductance Lpe of approximately 300 uH obtained from 48 primary winding turns Np and capacitance Cp of approximately 3.5 uF. The period 4·Tc in this case is approximately 200 usecs for a low frequency component of 5 kHz.

Likewise, for the preferred side-by-side winding, it is advantageous to not surround the coil with a metal housing, as is currently done for cooling purposes, since the leakage flux couples to the housing and produces eddy current losses. Preferably, housing of powder aluminum (or iron) in an epoxy base is preferred, or dual cooling fin/mounting sections 66*a* and 66*b* are preferred at the two ends of the laminations, as shown, which limit AC losses. The parts 66*a*/66*b* are mounted on the bottom edge of the ends of the laminations 61 which are exposed for good thermal contact. The mounts are of a height to allow air to circulate underneath the coil body 67.

For extracting heat from the coil core and windings, preferably the coil is encapsulated in a mold with thermal conductive material, e.g. alumina loaded epoxy, if practical, with the outer diameter 67 of the coil made as small as practical to allow heat generated from the outer sections of the windings to have a minimum distance to travel to the surface to be cooled, consistent with providing safe high voltage isolation. Diameter D of the coil is just larger than the outer dimension of the winding window 62 but much less than the lamination width Y to allow the outer sections of the laminations to be exposed to the air. The heat generated from the inner windings is conducted down the inner legs 61*a* and 61*b* of the laminations and out the ends to be carried away by the cooling fins 66*a* and 66*b* as well as by the entire outer perimeter sections 61*c* and 61*d* of the laminations which are exposed to the air by not being encapsulated or contained in an insulating housing. By molding the laminations, they do not have to be butt-welded which compromises their operation. Preferably, the high voltage tower 65*b* is fabricated as part of the molding process and located such that its center high voltage terminal lies along the surface of the last bay of the secondary winding for ease of connection. This also allows the top of the tower 65*b* to coincide with the top surface of the coil body 67.

Figure 7A:
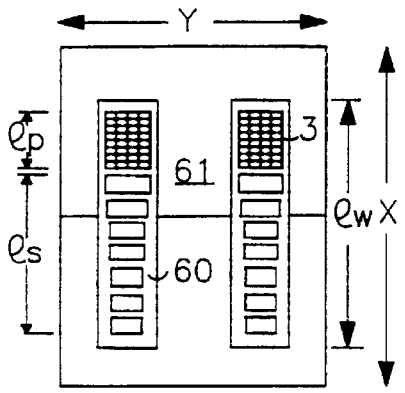
FIGS. 7*a*, 7*b*, and 7*c* are three partial views, approximately to-scale, of a preferred coil with side-by-side windings for the present application of a distributorless one-coil-per-plug ignition.
Figure 7B:
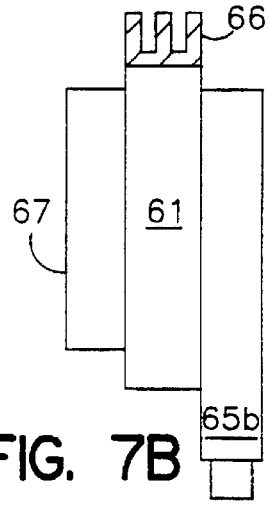
Figure 7C:
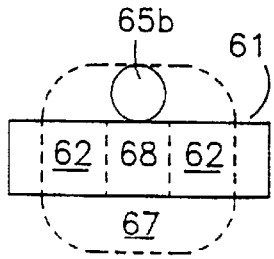

FIGS. 7*a*, 7*b*, and 7*c* are three partial views, approximately to-scale, of a preferred coil with side-by-side windings for the present application of a distributorless one-coil-per-plug ignition. Like numerals represent like parts with respect to FIGS. 6*a* and 6*b*. FIG. 7*a* corresponds to the drawing of FIG. 6*a* (but with both halves of the bobbin and windings shown) and represents a smaller coil operating with higher peak flux density, e.g. within 20% of saturation for a high stored energy of approximately 200 mJ. Operating at higher magnetic stress is practical since the coil operates at a much lower duty cycle than the single coil of the distributor system of FIG. 6*a*. As in the distributor ignition coil case, the primary winding has approximately 48 turns Np (but preferably 16 to 18 AWG magnet wire). The secondary winding has turns ratio of 30 to 70 for the 400 volt case, depending on output voltage requirements. The length of the winding "ls" is from approximately 1" (2.5 cms) as shown, to 1.5" (4 cm) or longer, depending on required peak output voltage, which can be as low as 20 kV and as high as 40 kV. The shorter length corresponds to a lower voltage application, e.g. a low-compression ratio industrial engine, with seven bays shown versus eight as in FIG. 6*a* (more or less bays as are needed as is known to those versed in the art). Overall dimensions shown are 1¾" (4.5 cms) for the Y dimension and 2¼" (6 cms) for the X dimension, taken as approximate dimensions of a preferred embodiment. The center leg section 68 is shown as square with a side of approximately ½" (1.2 cms) and the height of the winding window 62 is ⅜" (1 cm). The end section at the primary winding core half is shown to have proportionally wider flats for improved design. In this case, magnet wire is practical for the primary winding whose winding length lp is approximately ⅓ of ls. Also, from a cost point of view, one may have an E-lamination on the primary winding side that is approximately ⅓ (of X) instead of ½ (of X), which is preferably made of the more expensive 6 or 7 mil thin lamination, versus 9 to 14 mil lamination (for the secondary side) for best efficiency at acceptable cost.

FIG. 7*b* shows a side view corresponding to FIG. 6*b* but without the two heat sinks (which also act as mounts). They are replaced by a single optional heat sink 66 at the primary winding end where most of the heat is generated. It is located at the far end at a cooler section of the engine for the case where the high voltage tower 65*b* is placed close and down towards the spark plug end.

FIG. 7*c* shows a cross-section of the coil in FIG. 7*b* with the coil body 67 shown as approximately square, extending just over the far sections of the winding window 62. The high voltage tower 65*b* is contained within the outer profile of the coil body 67, making for a compact and lightweight design suitable for a one-coil-per-plug ignition. For lower stored energy, the coil can be made smaller, and of different shape.

Note that while the butted E-section design is preferred, it is not the only one suitable for a side-by-side winding coil, which can be interleaved, although the cost advantage of using two thicknesses of laminations, already disclosed, may be lost. In this respect, one can have two entirely different magnetic materials for the two core halves to maximize efficiency, including ones not as susceptible to losses from the leakage flux crossing the winding window, such as powder iron as already discussed with respect to the primary winding core half.

As already discussed, low resistance (below 20 ohms), high inductance spark plug wire 10 is assumed, e.g. with over 200 uH inductance to reduce the peak current from the coil secondary output capacitance without limiting the overall spark energy. Since this reduces the already low break-down spark due to low coil output capacitance, other steps must be taken to increase the break-down spark without producing EMI.

One approach disclosed elsewhere is to use capacitive boots which connect between the inductive wire 10 and the spark plug. These can be simple coaxial sections of about 5" length where the outer electrically conductive shield is terminated at the spark plug shell or engine block or other ground section. Such capacitive boots preferably have a capacitance of about 50 pF.

Figure 8:
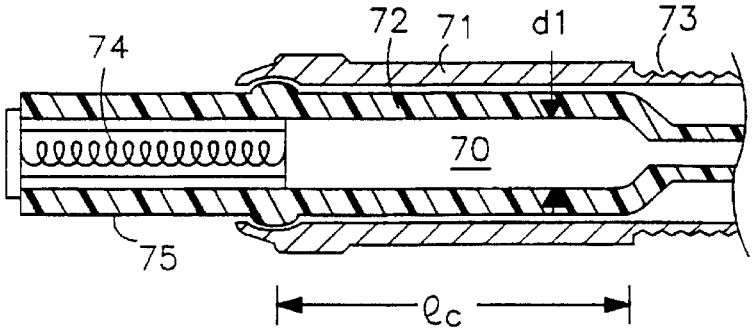
FIG. 8 is a side view of an improved capacitance spark plug with the firing end not shown.

A better approach is to build the capacitance in the spark plug, as shown in a not to-scale drawing in FIG. 8. It is a side-view of a capacitance spark plug with the firing end not shown. The high capacitance is achieved by having an elongated plug body section "lc" which can be about 1.5" (4 cms) long with large inner diameter high voltage electrode 70 of diameter "d1" approximately 0.2" (0.5 cms), and inner diameter "d2" of the plug shell section 71 approximately 0.4" (1 cm), for thickness of insulator 72 of approximately 0.1" (0.25 cm). Standard 14 mm thread is assumed for the plug thread 73. Using high purity alumina for the insulator 72, 30 pF of capacitance can be obtained from 1.6" (4 cm) of length "lc", assuming minimum air-gaps between the insulator and inner 70 and outer electrodes 71. This can be accomplished by coating the insulator along the section "lc" with conductive material which contacts the inner 70 and outer 71 electrodes. Center conductor 70 is preferably hollow to reduce weight. Insulating material 72 may also be other higher dielectric constant, high temperature ceramic material to provide a high capacitance with a short body length "lc", such as a mixture of alumina and zirconia, e.g. of 20% to 40% of zirconia in alumina. An inductor 74 may be included in the high voltage insulating tower 75 to suppress EMI.

Figure 9:
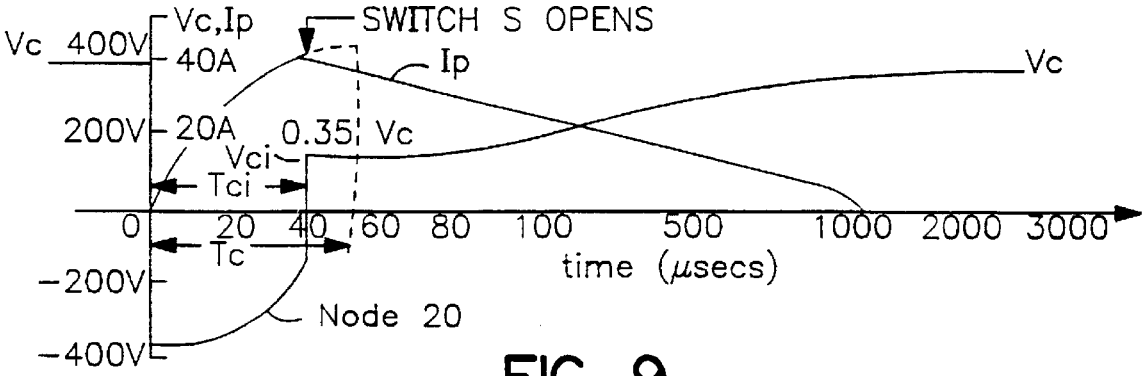
FIG. 9 is a graph of the primary circuit discharge voltage Vc and current Ip.

FIG. 9 depicts the topology II primary current Ip (with corresponding secondary current ls equal to Ip/N), the capacitor voltage Vc, and the voltage at node 20 (FIG. 4) on the primary winding side of the capacitor as a function of time (using a logarithm type scale). Following the ignition trigger, the current rises as a sine wave. The voltage at the IGBT collector is pulled to zero and the other side of the capacitor 6 at node 20 goes form zero to −Vc volts essentially instantly and then decays with a corresponding cosine wave. Prior to the current reaching its peak, switch S opens (at 40 usecs shown of an approximately 55 usec quarter period Tc), the primary current is diverted to the shunt diode 6 and decays to zero (in one millisecond shown). The voltage on the capacitor jumps to Vci (0.35·Vc shown) when the switch is opened, and then rises back to Vc of approximately 360 volts in a time dependent on the output of the power converter. This is preferably about 100 watts to give a recharge time of approximately 2 milliseconds (for 200 mJ stored energy), required for a V-8 engine running in excess of 6000 RPM, i.e. with 2.5 milliseconds or less between ignition firings.

It is noted that another particular advantage of the current systems using controlled turn-off of the discharge switches S/Si is that one can electronically control the amount of delivered spark energy without compromising the peak output voltage of the ignition. That is, one can design the system with sufficient capacitance Cp (6) to insure voltage doubling yet be able to deliver a small fraction of the stored energy, if preferred. Voltage doubling shall mean herein that the peak secondary voltage Vs shall be greater than 1.6 times that given by the product of input voltage Vc and turns ratio N, or the voltage doubling parameter VDP, defined as $N^2 \cdot Cs/C$, shall be less than 0.25, where Cs is the total coil output capacitance including the coil secondary winding capacitance and that of the spark plug boot and spark plug. This can help in such cases as cold start or transients where higher spark energy may be required (where the capacitor may be allowed to essentially fully discharge), and allow one to lower the spark energy when the engine is hot and stable. In all the preferred embodiments disclosed herein voltage doubling as defined above is expected to be designed in.

Efficiency of the ignition system is a main feature of this invention which can be more easily assessed, in the case of the ignition coil, through a term defined as the ignition coil dissipation factor ICDF, given by the ratio $Rpe/\sqrt{Lpe}$, where Rpe is the coil resistance in ohms and Lpe is the leakage inductance in millihenries (mH), as measured at the coil primary winding terminals with the secondary winding shorted. ICDF is the parameter that most distinguishes one ignition coil from another, and is related to but not equal to the more conventional dissipation factor. To obtain values of ICDF, measurements are made at the coil operating frequency, or 1 kHz for the case of a triangular, versus sinusoidal current distribution. For seven commercial performance CD coils which were measured, ICDF ranged from a low (low dissipation) of 0.9 to a high of 3.5. On the other hand, the present designs disclosed have ICDF values below one half the value of the lowest measured, i.e. below 0.5, as low as 0.2 for the distributor ignition coil based on the use of Litz wire in the primary winding and use of 6 mil laminations in the core half over which the primary winding is wound. When taken with the stored energy $I/2 \cdot Cp \cdot (Vc)^2$, spark load, and other circuit losses, e.g. switch and diode voltage drops, one can obtain a discharge circuit efficiency for the present embodiment of 70% or greater for a 800 volt zener load representing the spark gap (an industry standard), or more than twice that of other CD ignition systems. For the battery powered system, battery-to-spark efficiency of the present system is over 50%, as high as 60% or higher, versus 15% to 30% for others.

The consequences of the high efficiencies is that spark energy above 100 mJ can be delivered with a stored energy of 200 mJ, as high as 150 mJ for the distributor ignition case (whose coil is particularly efficient with ICDF as low as 0.15 to 0.2). In the case of distributorless one-coil-per-plug ignition, high efficiencies mean that high energy can be delivered for the smallest size coil to provide the highest energy density coils possible with minimum heat dissipation in the coil. Energy densities as high as 0.5 mJ/gm can be achieved, which are very high for a CD ignition coil.

It is emphasized that the main benefits of the preferred embodiments disclosed are achieved when utilized as a complete system of a ultra-high efficiency power converter (efficiency of 90% to 94%), a discharge circuit with a high efficiency switch S/Si such as a 30 amp IGBT, diode D/Di and switch SD (low voltage low RDS FET) if required, a high efficiency side-by-side winding coil with ICDF as low as of 0.15 to 0.3, low resistance spark plug wire, inductive or even straight solid conductor for older, non-computer controlled, distributor ignition cars (although high inductance wire is preferred for the coil to distributor wire), and spark plugs with built in capacitance and preferred spark plug electrode tips disclosed elsewhere for better coupling of the flow-resistant high energy arc discharge spark to the engine flows for best engine efficiency and minimum exhaust emissions. The high efficiency of the system and components means that the more useful 100 to 200 mJ spark energy can be delivered without undue heating of the power box which typically contains the power converter, discharge capacitor, switches and controllers, and undue heating of the ignition coil, which in the case of the distributorless ignition may be mounted close to the spark plug near or on the engine block which gets very hot.

Finally, this disclosure has tacitly or explicitly assumed that the capacitor operating voltage Vc is approximately 400 volts (400 volt capacitors are used). Based on that assumption, various parameter values have been cited. For lower or higher voltages, e.g. 300 or 500 volts, certain parameters need to be modified accordingly as is known to those versed in the art. The coil turns ratio N for the approximately same peak high voltage Vs is changed inversely with the value of Vc; the capacitance value Cp for the same stored energy is changed inversely as the square of the voltage; the power converter transformer turns ratio Ntr is changed in proportion to the voltage, and so on. However, with higher voltage, the initial coil discharge frequency increases for the same coil leakage inductance Lpe because of the reduction in Cp, although the peak current Ip is unchanged because of the higher impedance Ze given by $\sqrt{(Lpe/Cp)}$.

Since certain changes may be made in the above circuits and coil design without departing from the scope of the invention herein disclosed, it is intended that all matter contained in the above description, or shown in the accompanying drawings, shall be interpreted in an illustrative and not limiting sense.

What is claimed is:

1. A capacitive discharge ignition system for internal combustion engines comprising an ignition circuit for firing an ignitor element including at least one energy storage and discharge capacitor of capacitance Cp, and one ignition coil T per ignitor element of primary turns Np, secondary turns Ns, and with turns ratio N=Ns/Np, wherein coil T has a coil primary current switch means S which can be actively turned off, said capacitor Cp, primary winding of said coil T and switch S comprising a primary ignition discharge circuit of Topology Type II wherein said discharge capacitor means Cp is in series with the coil T primary winding, one end of which is grounded, the system powered by an electrical power source Eps for supplying power to the ignition system for charging capacitor Cp to a voltage Vc, the ignition system firing the ignitor to produce ignition sparks in a spark gap in the secondary winding of said coil T by discharging said capacitor means through actuation of said primary current switch means S, the improvement comprising:

a) a series combination of shunt diode means D and switch SD placed across the coil's primary winding with a voltage dropping element Vdb placed across switch SD, b) the system being constructed and arranged for producing an initial capacitive ignition spark discharge, through actuation of switch means S, of duration Tci which can be less than a quarter period of oscillation Tc defined by resonance oscillation of said capacitor Cp with the coil T primary leakage inductance Lpe, said initial discharge followed by an essentially triangular distribution decaying spark discharge of a longer period T which is initiated upon switch S turn-off resulting in diversion of the current flowing in switch S to the series combination shunt diode D and switch SD which is in the turned-on state, and c) the system further being constructed and arranged for turning off switch SD near spark current zero or after spark current zero to divert residual primary discharge current through said voltage dropping element Vdb.

2. An ignition system as defined in claim 1 constructed and arranged such that following triggering of said switch S for ignition firing said switch S is turned off prior to first full discharge of said capacitor Cp at most operating conditions.

3. An ignition system as defined in claim 2 constructed and arranged such that power source Eps is turned on following turn-off of said switch S to recharge said capacitor Cp through series combination of diode D and switch SD when SD is on, and through voltage dropping element Vdb when switch SD is off.

4. An ignition system as defined in claim 1 wherein said switch SD is low voltage, low RDS, N-type FET transistor.

5. An ignition system as defined in claim 1 wherein said voltage dropping element Vdb is a Zener diode.

6. An ignition system as defined in claim 1 wherein said voltage dropping element Vdb is a battery with an isolating diode in series.

7. An ignition system as defined in claim 1 wherein said voltage dropping element Vdb is a battery which powers a DC to DC converter with an isolating diode in series.

8. An ignition system as defined in claim 1 wherein said switches S is IGBT transistor.

9. An ignition system as defined in claim 1 constructed and arranged such that said electrical power source Eps is a DC to DC power converter which is turned off during turn-on of switch S and turned on during turn-off of said switch S to charge said capacitor Cp through diode D.

10. An ignition system as defined in claim 1 wherein signal for initial turning off of said switch SD is obtained from a sense resistor at the ground end of the secondary winding.

11. An ignition system as defined in claim 10 wherein said sense resistor at the ground end of the secondary winding is used in conjunction with a transistor which is turned on and off to provide the initial turn-on and turn-off signals to switch SD when the sense voltage at the sense resistor end goes above and below the transistor base-emitter voltage.

12. An ignition system as defined in claim 11 wherein the base of the transistor is connected to the sense resistor for the more common negative secondary current and the emitter is connected to the sense resistor, with base to ground, for positive current.

13. An ignition system as defined in claim 1 constructed and arranged such that switch S is turned off when the voltage Vci on said capacitor Cp drops to 20% to 40% of said voltage Vc.

14. An ignition system as defined in claim 1 wherein signal for turning off switch S is obtained, following triggering of the switch S, from the negative voltage available at the capacitor plate on the primary winding side of the coil T.

15. An ignition system as defined in claim 14 wherein signal for turning off switch S is obtained from a voltage divider resistor pair placed across the coil T primary winding.

16. An ignition system as defined in claim 1 wherein said power supply Eps is a battery power source and a DC to DC power converter for raising the battery voltage Vb to a higher voltage Vc to charge the CD capacitor of capacitance Cp, the power converter being a low electrical noise flyback type with input filter operating at a very high efficiency with one layer of primary transformer winding tightly wound over more than one layer of secondary winding magnet wire for high efficiency and low leakage inductance.

17. The ignition system of claim 1 wherein said coil T is an E-core with side-by-side primary and secondary windings.

18. The ignition system as defined in claim 17 wherein said coil T has primary turns Np between 40 and 60 turns and turns ratio N of 40 to 70.

19. The ignition system as defined claim 1 wherein the coil primary leakage inductance Lpe is between 200 uH and 500 uH.

20. The ignition system as defined in claim 1 wherein the voltage doubling parameter VDP defined by $N^2 \cdot Cs/Cp$, where Cs is the total coil output capacitance including the coil secondary winding capacitance and that of the spark plug boot and spark plug, is less than 0.25.

21. The ignition system as defined in claim 1 wherein said capacitor Cp is 400 voltage rating capacitor of capacitance Cp between 2 and 6 uF.

22. The ignition system as defined in claim 1 wherein the quarter period Tc is about 50 usecs.

23. The ignition system as defined in claim 17 wherein coil T is comprised of a bobbin with a single primary winding bay and secondary winding bays numbering between 7 and 10 bays.

24. An ignition system as defined in claims 1 wherein the spark plug used for creating the spark discharge has a built in high capacitance Cp1 above 20 pF.

25. An ignition system with spark plug as defined in claim 24 wherein high capacitance of the spark plug is obtained by metal coating one or both surfaces of the spark plug insulator along the spark plug body of length lc.

26. An ignition system with spark plug as defined in claim 24 wherein the high plug capacitance is obtained by using an insulator material composed of a combination of alumina and one or more other higher dielectric constant materials.

27. An ignition system with spark plug as defined in claim 26 wherein the insulator material of the spark plug is a combination of alumina and 15% to 40% zirconia.

28. An ignition system as defined in claims 1 wherein inductive spark plug wire is used for the spark plug wire.

29. An ignition system as defined in claim 28 wherein high capacitance spark plug is used with capacitance above 30 pF.

30. An ignition system as defined in claim 24 wherein said high capacitance spark plug includes an inductor placed inside the top insulating end connected to the spark plug.

31. An ignition system as defined in claim 1 and wherein the coil primary turns Np is approximately 50 turns and the turns ratio N is approximately 65.

32. An ignition system as defined in claim 1 wherein the peak primary current is approximately 40 amps and the peak secondary current is between 400 ma and 700 ma.

33. An ignition system as defined in claim 1 wherein the coil primary winding turns Np are between 40 and 60 and leakage inductance Lpe is between 200 and 500 uH.

* * * * *